US006825150B2

(12) United States Patent
Smith et al.

(10) Patent No.: US 6,825,150 B2
(45) Date of Patent: Nov. 30, 2004

(54) THERMAL DYE-TRANSFER RECEIVING ELEMENT WITH MICROVOIDED SUBSTRATE AND METHOD OF MAKING THE SAME

(75) Inventors: Dennis E. Smith, Rochester, NY (US); John Muehlbauer, Stafford, NY (US); Peter D. Rollinson, Rochester, NY (US); Thomas M. Laney, Spencerport, NY (US); Teh-Ming Kung, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 81 days.

(21) Appl. No.: 10/374,639

(22) Filed: Feb. 26, 2003

(65) Prior Publication Data

US 2004/0167027 A1 Aug. 26, 2004

(51) Int. Cl.[7] ..... B41M 5/035; B41M 5/38

(52) U.S. Cl. ..... 503/227; 264/176.1; 264/177.17; 264/291

(58) Field of Search ..... 8/471; 264/176.1, 264/177.17, 291

(56) References Cited

U.S. PATENT DOCUMENTS

| | | | | |
|---|---|---|---|---|
| 4,377,616 A | | 3/1983 | Ashcraft et al. | 428/213 |
| 5,342,821 A | * | 8/1994 | Pearce | 503/227 |
| RE34,742 E | | 9/1994 | Maier et al. | 428/36.5 |

* cited by examiner

*Primary Examiner*—Bruce H. Hess
(74) *Attorney, Agent, or Firm*—Kathleen Neuner Manne

(57) ABSTRACT

Disclosed is a thermal dye-transfer receiving element comprising a dye-image receiving layer on its top surface and, beneath the dye-image receiving layer, a microvoided layer containing a continuous phase polymer matrix having dispersed therein crosslinked organic microbeads, wherein the microbeads exhibit a glass transition temperature Tg that is below 80° C. Also disclosed is a method for making such thermal dye-transfer receiving elements.

40 Claims, No Drawings

THERMAL DYE-TRANSFER RECEIVING ELEMENT WITH MICROVOIDED SUBSTRATE AND METHOD OF MAKING THE SAME

FIELD OF THE INVENTION

The present invention relates to thermal dye-transfer receiving elements having at least one oriented layer comprising a continuous phase or matrix of a first polymer having microbeads of a second polymer dispersed therein which microbeads are at least partially bordered by voids. In particular, the second polymer is selected to provide microbeads that have a Tg below 80° C. The related method of making a thermal dye transfer element is also disclosed.

BACKGROUND OF THE INVENTION

In recent years, thermal transfer systems have been developed to obtain prints from pictures that have been generated electronically. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-transfer receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. A color hard copy is thus obtained which corresponds to the original picture viewed on a screen. Further details of this process and an apparatus for carrying it out are set forth in U.S. Pat. No. 4,621,271.

Thermal dye-transfer receiving elements used in thermal dye transfer generally comprise a polymeric dye image-receiving layer coated on a support. Supports are required to have, among other properties, adequate strength, dimensional stability, and heat resistance. For reflective viewing, supports are also desired to be as white as possible. Cellulose paper and plastic films have been proposed for use in the supports for the dye-transfer receiving element in efforts to meet these requirements. Recently, microvoided films formed by stretching an orientable polymer containing an incompatible organic or inorganic material have been suggested for use in dye-transfer receiving elements.

Various arrangements have been proposed to improve the imaging quality of dye-image receiving layers in thermal dye-transfer receiving elements. For example, JP 88-198,645 suggests the use, in a dye donor element, of a support comprising a polyester matrix with polypropylene particles as a microvoiding agent. EP 582,750 suggests the use of a non-voided polyester layer on a support.

U.S. Pat. No. 5,100,862 relates to microvoided supports for dye-receiving elements used in thermal dye-transfer systems. Polymeric microbeads are used as void initiators in a polymeric matrix to enable higher dye transfer efficiency. A problem exists with such support, however, in that in order to attain the high level of voiding necessary for desired dye transfer efficiency, the volumetric loading of the microbeads needs to be above 25% by volume of the polymeric matrix. The degree of voiding is preferably from about 30 to 60 volume percent. At these levels of loading, the tear strength of the film during manufacture is very low and results in very poor manufacturing efficiency due to tearing of the support.

U.S. Pat. No. 6,096,684 relates to porous polyester films suitable as supports for receiving elements used in thermal dye transfer systems. Polymers immiscible with a polyester are used in a base layer while an adjacent layer, upon which a dye-image receiving layer is formed, contains a polyester containing dispersed inorganic particles as void initiators. These inorganic particles are less than 1.0 $\mu$m in size. The porosity of this adjacent layer is specified to be not less than 20% by volume. This support solves the problem of poor adhesion of imaging layers to a support consisting only of the base layer. This support has also been shown to be manufacturable at high efficiency. A problem exists with this support, however, in that the hardness of the inorganic void initiators results in poor contact with the dye donor element. This results in low dye transfer efficiency for elements using such supports.

Blends of linear polyesters with other incompatible materials of organic or inorganic nature to form microvoided structures are well-known in the art. U.S. Pat. No. 3,154,461 discloses, for example, linear polyesters blended with, for example, calcium carbonate. U.S. Pat. No. 3,944,699 discloses blends of linear polyesters with 3 to 27% of organic material such as ethylene or propylene polymer. U.S. Pat. No. 3,640,944 also discloses the use of poly(ethylene terephthalate) blended with 8% organic material such as polysulfone or poly(4-methyl-1-pentene). U.S. Pat. No. 4,377,616 discloses a blend of polypropylene to serve as the matrix with a small percentage of another incompatible organic material, nylon, to initiate microvoiding in the polypropylene matrix. U.K. Patent Specification 1,563,591 discloses linear polyester polymers for making opaque thermoplastic film support in which has been blended finely divided particles of barium sulfate together with a void-promoting polyolefin, such as polyethylene, polypropylene or poly-4-methyl-1-pentene.

The above-mentioned patents show that it is well known to use incompatible blends to form microvoided films after such blends have been extruded into films and the films have been quenched, biaxially oriented and heat set. The minor component of the blend, due to its incompatibility with the major component of the blend, upon melt extrusion into film, forms generally spherical particles each of which initiates a microvoid in the resulting matrix formed by the major component. The melting points of the void initiating particles, in the use of organic materials, typically should be above the glass transition temperature of the major component of the blend and, in particular, above the temperature of biaxial orientation.

As indicated in U.S. Pat. No. 4,377,616 spherical particles initiate voids of unusual regularity and orientation in a stratified relationship throughout a matrix material after biaxial orientation of the extruded film. Each void tends to be of like shape, not necessarily of like size, since the size depends upon the size of the particle. The voids generally tend to be closed cells, and thus there is virtually no path open from one side of a biaxially oriented film to the other side through which liquid or gas can traverse. The term "void" is used herein to mean devoid of solid matter, although it is likely the "voids" contain a gas.

Upon biaxial orientation of the resulting extruded film, the film becomes white and opaque, the opacity resulting from light being scattered from the walls of the microvoids. The transmission of light through the film becomes lessened with increased number and with increased size of the microvoids relative to the size of a particle within each microvoid.

U.S. Pat. No. 3,944,699 also indicates that the extrusion, quenching and stretching of the film, in this case made from a polyester material, may be effected by any process which is known in the art for producing oriented film, such as by a flat film process or a bubble or tubular process. The flat film process involves extruding the blend through a slit dye and rapidly quenching the extruded web upon a chilled casting drum so that the polyester component of the film is quenched into the amorphous state. The quenched film is then biaxially oriented by stretching in mutually perpendicular directions at a temperature above the glass transition temperature of the polyester. The film may be stretched in one direction and then in a second direction or may be simultaneously stretched in both directions. After the film has been stretched, it is heat set by heating to a temperature sufficient to crystallize the polyester while restraining the film against retraction in both directions of stretching.

It has previously been taught that microbeads should have a glass transition temperature Tg of at least 20° C. higher than the Tg of the continuous phase polymer matrix. See U.S. Pat. Nos. 4,994,312; 5,143,765; and 5,156,905 and Re. 34,742.

Commonly assigned, copending U.S. Ser. No. 10/033,457, filed Dec. 27, 2001, is directed to shaped articles comprising an oriented first polymer continuous phase having dispersed therein crosslinked microbeads which are at least partially bordered by void space, wherein the monomers from which the microbeads are derived are selected to provide microbeads that are both low-yellowing and thermally stable.

It would be desirable to solve the problem, existing in the prior art, of surface irregularities, in thermal dye-transfer receiving elements, that cause image quality problems. It would be desirable to have a receiving element for thermal dye transfer that can be readily manufacturable and exhibits a high dye transfer efficiency

SUMMARY OF THE INVENTION

The invention provides thermal dye-transfer receiving elements ("receivers") comprising at least one microvoided layer that employs, as the voiding agent, crosslinked polymer microbeads, wherein the glass transition temperature of the microbeads is below 80° C. Applicants have found that more compliant microbeads can improve the image properties of the thermal dye-transfer element. In particular, improved dye efficiency and improved low-density uniformity can be obtained using the present invention.

In one preferred embodiment, the Tg of the microbeads is low enough to soften during the thermal printing process. The invention also provides a method of making thermal dye-transfer receivers.

DETAILED DESCRIPTION OF THE INVENTION

As indicated above, the present invention relates to a thermal dye-transfer receiving element comprising, from top to bottom, a dye-image receiving layer, a microvoided layer containing a continuous phase polymer matrix having dispersed therein crosslinked organic microbeads exhibiting a glass transition temperature Tg which is below 80° C., and a support. Preferably, the transition temperature Tg is less than 75° C., more preferably 35 to 70° C.

In one embodiment of the invention, the Tg of the microbeads is at least 15° C. below the Tg of the continuous phase polymer, preferably at least 45° C. below the Tg of the continuous phase polymer. The Tg of the microbeads can be controlled in various ways, including selection of the monomers making up the microbeads and/or the extent of crosslinking.

As defined herein, the glass transition temperatures are determined by the method of differential scanning calorimetry (DSC) at a scanning rate of 20.degree. C./minute and the onset in the change in heat capacity is taken as the Tg.

In a preferred embodiment, the microvoided layer has a void volume of between 25% and 60 volume % and a density of less than 0.95 grams/cc, preferably a density of between 0.4 and 0.85 grams/cc.

Dye-receiving element:

The thermal dye-transfer receiving elements of the invention typically comprise, on the top surface, a dye-image receiving layer that may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 $g/m^2$. In a preferred embodiment of the invention, the dye image-receiving layer is a polycarbonate, polyester or blend of the two. The term "polycarbonate" as used herein means a polyester of carbonic acid and a glycol or a dihydric phenol. Examples of such glycols or dihydric phenols are p-xylylene glycol, 2,2-bis(4-oxyphenyl)propane, bis(4-oxyphenyl)methane, 1,1-bis(4-oxyphenyl)ethane, 1,1-bis(oxyphenyl)butane, 1,1-bis(oxyphenyl)cyclohexane, and 2,2-bis(oxyphenyl)butane. In a particularly preferred embodiment, a bisphenol-A polycarbonate having a number average molecular weight of at least about 25,000 is used. Examples of preferred polycarbonates include General Electric LEXAN® Polycarbonate Resin and Bayer AG MACROLON 5700®.

In a preferred embodiment of the invention, the dye-image receiving layer comprises a polymeric binder containing a polyester and/or polycarbonate. In another embodiment, the dye-image receiving layer comprises a blend of a polyester and a polycarbonate polymer. Preferably, such blends comprise the polyester and polycarbonate in a weight ratio of polyester to polycarbonate of 0.8:1 to 4.0:1. In the preferred embodiment, the polyester comprises polyethylene(terephthalate) or a blend thereof. For example, the polyester of the microvoided layer can be a blend comprising polyethylene(terephthalate) and poly(1,4-cyclohexylene dimethylene terephthalate).

As conventional, the dye-image receiving layer further can further comprise a release agent. Conventional release agents include but are not limited to silicone or fluorine based compound. Resistance to sticking during thermal printing may be enhanced by the addition of such release agents to the dye-receiving layer or to an overcoat layer. Various releasing agents are disclosed, for example, in U.S. Pat. Nos. 4,820,687 and 4,695,286, the disclosures of which are hereby incorporated by reference in their entirety.

A preferred release agent, especially for an extruded dye-receiving layer, are high or ultrahigh molecular weight silicone-based compounds. Preferably, the weight average molecular weight of the compound or polymer should be at least 100,000, more preferably at least 500,000, most preferably at least 1,000,000, for example, between 1,000,000 and 5,000,000. The silicone release agent should be compatible with the polymers used in the dye receiving layer. When the dye-receiving layer contains a polycarbonate, it is preferred for the relase agent to have hydroxy terminal groups to improve the compatibility of the silicone compound in the polycarbonate-containing blend.

High or ultrahigh molecular weight silicone release agents are commercially available, for example, from Dow Corning (Midland, Mich.), including MB50-315 and MB-010. MB50-315 is a hydroxy-terminated dimethyl siloxane. MB50-315 silicone material is commercially available as a 50 weight percent mixture of pelletized solid polydimethylsiloxane dispersed in polycarbonate polymer. Depending on the composition of the dye-receiving layer, other dispersions may be preferred, for example, MB50-010 from Dow Corning which is a dispersion in polyester.

A plasticizer may be present in the dye image-receiving layer in any amount which is effective for the intended purpose. In general, good results have been obtained when the plasticizer is present in an amount of from about 5 to about 100%, preferably from about 10 to about 20%, based on the weight of the polymeric binder in the dye image-receiving layer.

In one embodiment of the invention, an aliphatic ester plasticizer is employed in the dye image-receiving layer. Suitable aliphatic ester plasticizers include both monomeric esters and polymeric esters. Examples of aliphatic monomeric esters include ditridecyl phthalate, dicyclohexyl phthalate and dioctylsebacate. Examples of aliphatic polyesters include polycaprolactone, poly(1,4-butylene adipate) and poly(hexamethylene sebacate).

In a preferred embodiment of the invention, the monomeric ester is dioctylsebacate or bis-(1-octyloxy-2,2,6,6-tetramethyl-4-piperidinyl)sebacate, Tinuvin 123® (Ciba Geigy Co.). In another preferred embodiment, the aliphatic polyester is poly(1,4-butylene adipate) or the 1,3-butane diol polymer with hexanedioc acid, 2-ethylhexyl ester, sold commercially as Admex 429® (Velsicol Chemical Corp.) or poly(hexamethylene sebacate).

If the dye-receiving layer is to be made by extruding rather than by solvent coating the dye-receiving layer, then it has been found advantageous to include, as an additive to the composition of the dye-receiving layer, a phosphorous-containing stabilizer such as phosphorous acid or an organic diphosphite such as bis(2-ethylhexyl)phosphite, to prevent degradation of the polyester polymer blend during high temperature melt extrusion. The phosphorous stabilizer can be combined, for example, with a plasticizer such as dioctyl sebacate or the like. Preferably, to improve compatibility, the plasticizer is combined with the stabilizer prior to combining both with the other components of the dye receiving layer.

The structure of the dye-receiving element can vary, but is generally a multilayer structure comprising three sections, namely, a dye-receiving layer, a composite compliant film comprising the microvoided layer, and a composite support. In addition, tie layers or subbing layers can be employed between adjacent layers within a section or between sections. Typically, the receiving element has a total thickness of from 20 to 400 micrometers, preferably 30 to 300 micrometers.

In one receiver structure, for example, beneath the microvoided layer, there is a second microvoided layer comprised of a second continuous phase polyester matrix having dispersed therein non-crosslinked polymer particles that are immiscible with the polyester matrix of said second microvoided layer. In one embodiment, the composite comprising the two microvoided layers is laminated to a composite support.

In an alternative embodiment, beneath the microvoided layer, there is a second layer comprised of a non-voided polyester. The composite comprising these two layers can be laminated to a composite support.

In still another embodiment, the microvoided layer further contains non-crosslinked polymer particles that are immiscible with the polymer matrix of said microvoided layer. It is further possible that beneath this microvoided layer, there is a second microvoided layer comprised of a second continuous phase polyester matrix having dispersed therein non-crosslinked polymer particles that are immiscible with the polyester matrix of said second microvoided layer. Again, in one embodiment of a receiver according to the invention, a composite comprising the two microvoided layers can be laminated to a composite support.

In a preferred embodiment, as indicated above, beneath the one or more microvoided layers is a paper-containing support, more preferably a resin-coated paper support. The support can comprise one or more subbing layers or tie layers.

Typically, a support comprises cellulose fiber paper. Preferably, the support is from 120 to 250 $\mu$m thick and the applied composite laminate film is from 30 to 50 $\mu$m thick. The support can further comprise a backing layer, preferably a polyolefin backing layer on the side of the support opposite to the composite film and a tie layer between the support and the laminate film.

Properties:

The special microvoided layer in the thermal dye-transfer receiving elements of the present invention, as generally described above, exhibits certain desirable properties. These properties include desirable texture, opacity, low density, whiteness, and stability. Especially, however, the microvoided layer provides more compliant properties to the receiver. This is important as it impacts the degree of contact to the thermal head during printing. Higher compliance results in better contact and higher dye transfer efficiency due to improved thermal transfer.

The microvoided layer comprises, in a continuous thermoplastic polymer phase, microbeads of polymer that are at least partially bordered by microvoids. The microbeads of polymer suitably having a size of about 0.1–50 micrometers, typically about 0.2–30 micrometers, and usually about 0.5 to 5 micrometers, being present in an amount of about 5–50% by weight based on the weight of continuous phase polymer. The microvoids typically occupy about 2–60%, preferably 30 to 50%, by volume of the shaped article and typically measure from 0.6 to 150 $\mu$m in machine and cross-machine direction with a height of 0.2 to 30 $\mu$m and, more commonly, 1.5–25 $\mu$m in machine and cross-machine direction with a height of 0.5 to 5.0 $\mu$m. Depending on the manner in which the shaped articles are made, the voids may completely encircle the microbeads, e.g., a void may be in the shape of a doughnut (or flattened doughnut) encircling a microbead, or the voids may only partially border the microbeads, e.g., a pair of voids may border a microbead on opposite sides.

The composition of the microvoided layer alone typically exhibits a specific gravity of less than 1.20, typically about 0.3–1.0; by a Kubelka-Munk R value (infinite thickness) of about 0.90 to about 1.0, and typically the following Kubelka-Munk values when formed into a 3 mil thick film:

Opacity—about 0.78 to about 1.0

SX—25 or less

KX—about 0.001 to 0.2

Ti—about 0.02 to 1.0 where the opacity values indicate that the article is opaque, the SX values indicate a large amount of light scattering through the thickness of the articles, the KX values indicate a low amount of light absorption through the thickness of the article, and the Ti values indicate a low level amount of internal transmittance of the thickness of the article. The R (infinite thickness) values indicate a large amount of light reflectance. Obviously, the Kubelka-Munk values which are dependent on thickness of the article must be specified at a certain thickness. Although the microvoided layer can vary in thickness, the Kubelka-Munk values, except for R infinity, are specified at 3 mils and in the absence of any additives which would effect optical properties. Thus, to determine whether microvoided layer according to the present invention has the optical properties called for in a particular application, the microbeads at least partially bordered by voids, without additives, should be formed in a 3 mils thick film for determination of Kubelka-Munk values.

The continuous first polymer phase polymer may be any thermoplastic polymer capable of being cast into a film or sheet and then oriented, spun into fibers, extruded into rods or extrusion, blow-molded into containers such as bottles, etc. Suitable classes of thermoplastic polymers include polyesters, polyolefins, polyamides, polycarbonates, cellulosic esters, polystyrene, polyvinyl resins, polysulfonamides, polyethers, polyimides, polyvinylidene fluoride, polyurethanes, polyphenylenesulfides, polytetrafluoroethylene, polyacetals, and polysulfonates. Copolymers and/or mixtures of these polymers can also be used. Suitable polyesters include those produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well-known techniques, e.g., those described in U.S. Pat. Nos. 2,465,319 and 2,901,466. Preferred continuous matrix polyesters are those having repeat units from terephthalic acid or naphthalene dicarboxylic acid and at least one glycol selected from ethylene glycol, 1,4-butanediol and 1,4-cyclohexanedimethanol. Poly(ethyleneterephthalate), which may be modified by small amounts of other monomers, is especially preferred. Other suitable polyesters include liquid crystal copolyesters formed by the inclusion of a suitable amount of a co-acid component such as stilbene dicarboxylic acid. Examples of such liquid crystal copolyesters are those disclosed in U.S. Pat. Nos. 4,420,607, 4,459,402 and 4,468,510. Suitable polyolefins include polyethylene, polypropylene, polymethylpentene, and mixtures thereof. Polyolefin copolymers, including copolymers of ethylene and propylene are also useful. Useful polyamides are nylon 6, nylon 66, and mixtures thereof. Copolymers of polyamides are also suitable continuous phase polymers. An example of a useful polycarbonates is bisphenol A polycarbonate. Cellulosic esters suitable for use as the continuous phase polymer are cellulose nitrate, cellulose triacetate, cellulose diacetate, cellulose acetate propionate, cellulose acetate butyrate, and mixtures or copolymers thereof. Useful polyvinyl resins include polyvinyl chloridepoly(vinyl acetal), and mixtures thereof. Copolymers of vinyl resins can also be utilized.

In contrast to prior art microbeads, which are harder and have a higher Tg, it has been found that the crosslinked organic microbeads of the invention which have a lower Tg are compressed under the weight of the thermal print head during printing, thereby allowing better contact between the dye-donor and dye-receiver elements. When microbeads having a high Tg are used, the microbeads are too rigid and prevent intimate contact between the dye-donor and dye-receiver during printing, resulting in image mottle and poor image quality. The improved dye-donor/dye-receiver contact achievable with the low Tg microbeads of the invention results in reduced mottle and improved image quality.

In the embodiments of this invention, the crosslinked microbeads employed in the invention preferably have a Tg which is lower than the Tg of the continuous phase polymer.

In one preferred embodiment of the invention, the low Tg microbeads are made from an acrylic polymer or copolymer, such as butyl-, ethyl-, propyl-, hexyl-, 2-ethyl hexyl-, 2-chloroethyl-, 4-chlorobutyl- or 2-ethoxyethyl-acrylate or methacrylate, etc.; or a styrenic copolymer, such as styrene-butadiene, styrene-acrylonitrile-butadiene, styrene-isoprene, hydrogenated styrene-butadiene, etc., or mixtures thereof.

One of the ethylenically unsaturated monomers used to form the microbeads must form a homopolymer with a Tg less than 80° C. and may include, for example, the following monomers and their mixtures: 4-butyl styrene, 4-hexyl styrene, vinyl methyl ether, decyl methacrylate, dodecyl methacrylate, ethylhexyl methacrylate, hexadecyl methacrylate, octyl methacrylate, lauryl methacrylate, octadecyl methacrylate, nonyl acrylate, octyl acrylate, propyl acrylate, methyl acrylate, butyl acrylate, heptyl acrylate, ethyl acrylate, dodecyl acrylate, 2-hydroxyethyl acrylate, lauryl acrylate, isobutyl acrylate and cyclohexyl acrylate. Preferably the monomer is butyl acrylate and ethyl acrylate.

In the case of a copolymer, one or more of the ethylenically unsaturated monomers used to form the microbeads, when in the form of a homopolymer, has a Tg less than 80° C.

Suitable other ethylenically unsaturated monomers which form a homopolymer with a Tg greater than 80° C. include, for example, t-butyl acrylate, pentachlorophenyl acrylate, 4-phenyl acrylate, ferrocenylethyl acrylate, ferrocenylmethyl acrylate, isobomyl acrylate, 3,5-dimethyl adamantyl acrylate, t-butyl acrylamide, isohexyl acryl amide, morpholyl acryl amide, adamantyl methacrylate, isobutyl methacrylate, t-butyl methacrylate, 2-chloroethyl methacrylate, 4-cyanophenyl methacrylate, isobornyl methacrylate, 3,3-dimethyl-2-butyl methacrylate, methyl methacrylate, phenyl methacrylate, 4-t-bulylphenyl methacrylate, t-butyl methacrylamide, methyl phenyl acrylate, acrylonitrile, methacrylonitrile, ethylvinyl benzene, styrene, vinyl toluene, chloromethyl styrene and 4-t-butyl styrene. Preferably the other monomers are methyl methacrylate, styrene, ethylvinyl benzene and vinyl toluene.

The microbeads of the invention are crosslinked so that they are more elastic as compared to plastic. Crosslinking can be achieved by the use of certain crosslinking monomers. Suitable crosslinking monomers are ethylenically unsaturated monomers with two or more ethylenically unsaturated groups and may include, for example, the following monomers and their mixtures: esters of unsaturated monohydric alcohols with unsaturated monocarboxylic acids, such as allyl methacrylate, allyl acrylate, butenyl acrylate, undecenyl acrylate, undecenyl methacrylate, vinyl acrylate, and vinyl methacrylate; dienes such as butadiene and isoprene; esters of saturated glycols or diols with unsaturated monocarboxylic acids, such as, ethylene glycol diacrylate, ethylene glycol dimethacrylate, hexane diol diacrylate, triethylene glycol dimethacrylate, 1,4-butanediol dimethacrylate, 1,3-butanediol dimethacrylate, pentaerythritol tetraacrylate, trimethylol propane trimethacrylate, trimethylol propane triacrylate and polyfunctional aromatic compounds such as divinylbenzene and the like. Preferably, the crosslinking monomer is ethylene glycol dimethacrylate, ethylene glycol diacrylate, 1,4-butanediol dimethylacrylate, hexane diol diacrylate, trimethylol propane triacrylate or divinylbenzene and most preferably hexane diol diacrylate or trimethylol propane triacrylate. Any amount of crosslinking monomer can be used as long as the resultant microbeads have the desired Tg. Preferably the crosslinking monomer is 2.5 to 50 wt % of the total monomer used and most preferably 20 to 40 wt %.

Processes well known in the art yield non-uniformly sized particles, characterized by broad particle size distributions. The resulting beads can be classified by screening to produce beads spanning the range of the original distribution of sizes. Other processes such as suspension polymerization, limited coalescence, directly yield very uniformly sized particles. Optionally, suitable slip agents or lubricants including colloidal silica, colloidal alumina, and metal oxides such as tin oxide and aluminum oxide can be on the microbead surface. The preferred slip agents are colloidal silica and alumina, most preferably, silica. The cross-linked microbeads may be prepared by procedures well known in the art. For example, conventional suspension polymerization or emulsion polymerization processes. It is preferred to use the "limited coalescence" technique for producing the cross-linked polymer microbeads. This process is described in detail in U.S. Pat. Nos. 3,615,972 and 5,378,577, incorporated herein by reference. Preparation of the microbeads for use in the present invention does not utilize a blowing agent as described in U.S. Pat. No. 3,615,972, however. The following general procedure may be utilized in a limited coalescence technique.

1. The polymerizable liquid is dispersed within an aqueous nonsolvent liquid medium to form a dispersion of droplets having sizes not larger than the size desired for the polymer microbeads, whereupon 2. The dispersion is allowed to rest and to reside with only mild or no agitation for a time during which a limited coalescence of the dispersed droplets takes place with the formation of a lesser number of larger droplets, such coalescence being limited due to the composition of the suspending medium, the size of the dispersed droplets thereby becoming remarkably uniform and of a desired magnitude, and 3. The uniform droplet dispersion is then optionally stabilized by addition of thickening agents to the aqueous suspending medium, whereby the uniform-sized dispersed droplets are further protected against coalescence and are also retarded from concentrating in the dispersion due to difference in density of the disperse phase and continuous phase, and 4. The polymerizable liquid or oil phase in such stabilized dispersion is subjected to polymerization conditions and polymerized, whereby globules of polymer are obtained having spheroidal shape and remarkably uniform and desired size, which size is predetermined principally by the composition of the initial aqueous liquid suspending medium. The diameter of the droplets of polymerizable liquid, and hence the diameter of the beads of polymer, can be varied predictably, by deliberate variation of the composition of the aqueous liquid dispersion, within the range of from about one-half of a micron or less to about 0.5 centimeter. For any specific operation, the range of diameters of the droplets of liquid, and hence of polymer beads, has a factor in the order of three or less as contrasted to factors of 10 or more for diameters of droplets and beads prepared by usual suspension polymerization methods employing critical agitation procedures. Since the bead size, e.g., diameter, in the present method is determined principally by the composition of the aqueous dispersion, the mechanical conditions, such as the degree of agitation, the size and design of the apparatus used, and the scale of operation, are not highly critical. Furthermore, by employing the same composition, the operations can be repeated, or the scale of operations can be changed, and substantially the same results can be obtained.

As indicated above, the microbeads referred to herein can optionally have a coating of a "slip agent" such as silica. By this term it is meant that the friction at the surface of the microbeads is greatly reduced. Slip agent may be formed on the surface of the microbeads during their formation by including it in the suspension polymerization mix. Microbead size may be regulated, for example, by the ratio of silica to monomer. Typically, as mentioned above, the microbeads of cross-linked polymer range in size from about, 0.1–50 microns, and are present in an amount of about 5–50% by weight based on the weight of the continuous phase polymer.

The invention does not require but permits the use or addition of a plurality of organic and inorganic materials such as fillers, pigments, antiblocks, antistats, plasticizers, dyes, stabilizers, nucleating agents, optical brighteners, etc. These materials may be incorporated into the matrix phases, into the dispersed phases, or may exist as separate dispersed phases. During stretching the voids assume characteristic shapes from the balanced biaxial orientation of paper-like films to the uniaxial orientation of microvoided/satin-like fibers. Balanced microvoids are largely circular in the plane of orientation while fiber microvoids are elongated in the direction of the fiber axis. The size of the microvoids and the ultimate physical properties depend upon the degree and balance of the orientation, temperature and rate of stretching, crystallization kinetics, the size distribution of the microbeads, and the like.

The microvoided layers according to this invention may be prepared by (a) forming a mixture of molten continuous matrix polymer and cross-linked polymer wherein the cross-linked polymer is a multiplicity of microbeads uniformly dispersed throughout the matrix polymer, the matrix polymer being as described herein before, the cross-linked polymer microbeads being as described herein before, (b) forming a shaped article from the mixture such as by extrusion, casting or molding, (c) orienting the article such as by stretching to form microbeads of cross-linked polymer uniformly distributed throughout the article and voids at least partially bordering the microbeads on sides thereof in the direction, or directions of orientation.

The mixture may be formed by forming a melt of the matrix polymer and mixing therein the cross-linked polymer. The cross-linked polymer may be in the form of solid or semi-solid microbeads. Due to the incompatibility between the matrix polymer and crosslinked polymer, there is no attraction or adhesion between them, and they become uniformly dispersed in the matrix polymer upon mixing.

During melt processing the orientable polymer does not react chemically or physically with the microbead polymer and/or its coating in such a way as to cause one or more of the following to occur to a significant or unacceptable degree: (a) alteration of the crystallization kinetics of the matrix polymer making it difficult to orient, (b) destruction of the matrix polymer, (c) destruction of the microbeads, (d) adhesion of the microbeads to the matrix polymer, or (e) generation of undesirable reaction products, such as toxic or high-color moieties.

When the microbeads have become uniformly dispersed in the matrix polymer, a film or sheet can be formed by processes such as extrusion or casting. Such forming methods are well known in the art. If sheets or film material are cast or extruded, it is important that such article be oriented by stretching, at least in one direction. Methods of unilaterally or bilaterally orienting sheet or film material are well known in the art. Basically, such methods comprise stretching the sheet or film at least in the machine or longitudinal direction after it is cast or extruded an amount of about 1.5–10 times its original dimension. Such sheet or film may also be stretched in the transverse or cross-machine direction by apparatus and methods well known in the art, in amounts of generally 1.5–10 (usually 3–4 for polyesters and 6–10 for polypropylene) times the original dimension. Such apparatus and methods are well known in the art and are described in U.S. Pat. No. 3,903,234, incorporated herein by reference.

The voids, or void spaces, referred to herein surrounding the microbeads are formed as the continuous matrix polymer is stretched at a temperature above the Tg of the matrix polymer. The microbeads of cross-linked polymer are relatively hard compared to the continuous matrix polymer. Also, due to the incompatibility and immiscibility between the microbead and the matrix polymer, the continuous matrix polymer slides over the microbeads as it is stretched, causing voids to be formed at the sides in the direction or directions of stretch, which voids elongate as the matrix polymer continues to be stretched. Thus, the final size and shape of the voids depends on the direction(s) and amount of stretching. If stretching is only in one direction, microvoids will form at the sides of the microbeads in the direction of stretching. If stretching is in two directions (bidirectional stretching), in effect such stretching has vector components extending radially from any given position to result in a doughnut-shaped void surrounding each microbead.

The preferred preform stretching operation simultaneously opens the microvoids and orients the matrix material. The final product properties depend on and can be controlled by stretching time-temperature relationships and on the type and degree of stretch. For maximum opacity and texture, the stretching is done just above the glass transition temperature of the matrix polymer. When stretching is done in the neighborhood of the higher glass transition temperature, both phases may stretch together and opacity decreases.

In general, void formation occurs independent of, and does not require, crystalline orientation of the matrix polymer. Opaque, microvoided films have been made in accordance with the methods of this invention using completely amorphous, non-crystallizing copolyesters as the matrix phase. Crystallizable/orientable (strain hardening) matrix materials are preferred for some properties like tensile strength and barrier. On the other hand, amorphous matrix materials have special utility in other areas like tear resistance and heat sealability. The specific matrix composition can be tailored to meet many product needs. The complete range from crystalline to amorphous matrix polymer is part of the invention.

Other ingredients are often added such as surfactants, emulsifiers, pigments, and the like during the preparation of such microbeads. Due to the nature of these additives, they tend to remain on the surfaces of the microbeads. In other words, they tend to accumulate at the interface between the polymer and the immiscible medium in which the suspension polymerization is carried out. However, due to the nature of such processes, some of these materials can remain within the core of the beads and some in the immiscible medium. For example, processing and formulating may be done to entrap ingredients within the beads. In other cases, the goal may be to concentrate ingredients on the surface of the beads.

In a preferred embodiment of making a thermal dye-transfer receiving element according to the present invention, the process comprises, in order, the following steps. First a polymeric laminate film is coextruded to form a cast composite film comprising at least two layers, a first layer comprising a non-voided thermoplastic polymeric material and a second layer comprising a continuous phase polymer matrix having dispersed therein crosslinked organic microbeads, wherein the microbeads exhibit a glass transition temperature Tg that is less than 80° C. Second, the cast composite film is stretched to reduce its thickness, thereby obtaining an oriented composite film comprising, as the first layer, a dye-image receiving layer and, as the second layer, a microvoided compliant layer. Next, the oriented composite film is laminated to a support, such that the microvoided compliant layer is between the dye-image receiving layer and the support.

A dye-donor element that is used with the thermal dye-receiving element of the invention comprises a support having thereon a dye containing layer. Any dye can be used in the dye-donor employed in the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3RFS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

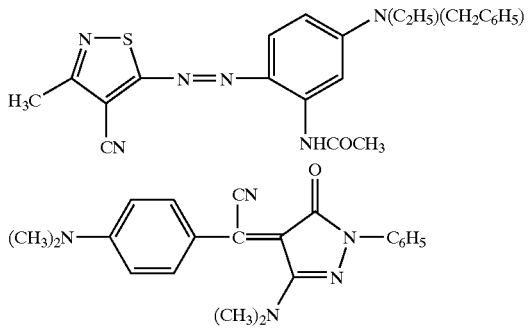

-continued

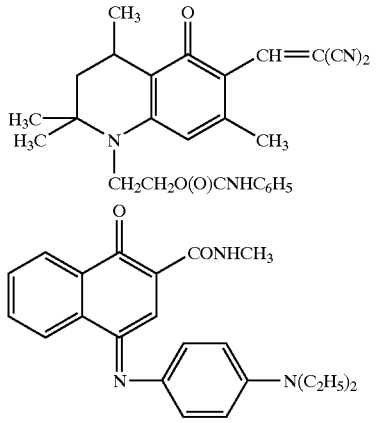

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m2 and are preferably hydrophobic.

The dye in the dye-donor element is dispersed in a polymeric binder such as a cellulose derivative, e.g., cellulose acetate hydrogenphthalate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process. The reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of from about 0.001 to about 2 g/m$^2$. If a polymeric binder is employed, the lubricating material is present in the range of 0.1 to 50 wt %, preferably 0.5 to 40, of the polymeric binder employed.

As noted above, the dye-donor elements and receiving elements of the invention are used to form a dye transfer image. Such a process comprises imagewise-heating a dye-donor element as described above and transferring a dye image to a dye-receiving element to form the dye transfer image.

The dye-donor element may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two- three- or four-color elements (or higher numbers also) are included within the scope of the invention.

In a preferred embodiment, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Another aspect of the present invention relates to a method of forming an image comprising imagewise thermally transferring dyes onto a receiving element according to the present invention, such that the microbeads soften during the thermal printing process.

Thermal printing heads which can be used to transfer dye from the dye-donor elements to the receiving elements are available commercially. There can be employed, for example, a Fujitsu Thermal Head (FTP-040MCS001), a TDK Thermal Head F415 HH7-1089 or a Rohm Thermal Head KE 2008-F3.

A thermal dye transfer assemblage of the invention comprises: a) a dye-donor element as described above, and b) a dye-receiving element as described above, the dye-receiving element being in a superposed relationship with the dye-donor element so that the dye layer of the donor element is in contact with the dye image-receiving layer of the receiving element. The above assemblage comprising these two elements may be pre-assembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

EXAMPLES

For all examples below the resin pellets used to extrude the dye receiving layer were formulated by introducing the following components into a Leistritz 27 mm Twin Screw Compounding Extruder heated to 210° C.:

1) Polyester: 157.45 kg (914.46 moles) of cis and trans isomers of cyclohexanedicarboxylic acid, 144.66 kg (457.23 moles) of bisphenol A diethanol, 2.45 kg (18.29 moles) of trimethylolpropane, 66.47 kg (460.89 moles) of cis and trans isomers of cyclohexanedimethanol and 82.51 g of butylstannoic acid catalyst were added to a 150 gallon polyester reactor equipped with a low speed helical agitator. The batch was heated to a final temperature of 275° C. The water byproduct of the esterification reaction began to distill over at 171° C. after about two hours of heat-up. Two hours later at an internal temperature of 267° C., the reactor pressure was ramped down at 10 mm Hg per minute to 3 mm Hg absolute pressure. After two hours under vacuum, the pressure was reduced to 1 mm Hg. After 3 hours and 30 minutes total under vacuum the vacuum was relieved with nitrogen and the very viscous polyester was drained from the reactor onto trays which cooled overnight. The solidified polyester was ground through a ¼" screen. The inherent viscosity in methylene chloride at 0.25% solids was 0.58, the absolute Mw was 102,000, the Mw/Mn was 6.3 and the glass transition temperature by DSC on the second heat was 55.8° C.

2) Polycarbonate (Lexan® 141 from GE Polymers) at 29.2% wt

3) Polyester elastomer with Silicone (MB50-10 from Dow Corning) at 4% wt

4) Dioctyl Sebacate(from Acros Organics) at 2.6% wt.

5) Poly(1,3-butylene glycol adipate) (Admex®429) at 2.6% wt

6) Stabilizer(Weston® 619) at 0.2%

The melted mixture was extruded as a strand into a water bath and then pelletized.

Preparation of Dye-Donor Elements:

The dye-donor used in the example is Kodak Ektathern ExtraLife® donor ribbon made as follows:

A 4-patch protective layer dye-donor element was prepared by coating on a 6 μm poly(ethylene terephthalate) support:

1) a subbing layer of titanium alkoxide (DuPont Tyzor TBT®) (0.12 g/m2) from a n-propyl acetate and n-butyl alcohol solvent mixture, and 2) a slipping layer containing an aminopropyidimethyl-terminated polydimethylsiloxane, PS513® (United Chemical Technologies, Inc.)(0.01 g/m$^2$), a poly(vinyl acetal) binder, KS-1 (Sekisui Co.) (0.38 g/m2), p-toluenesulfonic acid (0.0003 g/m$^2$), polymethylsilsesquioxane beads 0.5 μm (0.06 g/m$^2$) and candellila wax (0.02 g/m$^2$) coated from a solvent mixture of diethyl ketone and methanol.

On the opposite side of the support was coated:

1) a patch-coated subbing layer of titanium alkoxide (TyzorTBT®) (0.13 g/m$^2$) from a n-propyl acetate and n-butyl alcohol solvent mixture, and 2) repeating yellow, magenta and cyan dye patches containing the compositions as noted below over the subbing layer and a protective patch on the unsubbed portion as identified below.

The yellow composition contained 0.07 g/m$^2$ of the first yellow dye illustrated above, 0.09 g/m$^2$ of the second yellow dye illustrated above, 0.25 g/m$^2$ of CAP48220 (20 s viscosity) cellulose acetate propionate, 0.05 g/m$^2$ of Paraplex G-25® plasticizer and 0.004 g/m$^2$ divinylbenzene beads (2 μm beads) in a solvent mixture of toluene, methanol and cyclopentanone (66.5/28.5/5).

The magenta composition contained 0.07 g/m$^2$ of the first magenta dye illustrated above, 0.14 g/m$^2$ of the second magenta dye illustrated above, 0.06 g/m$^2$ of the third magenta dye illustrated above, 0.28 g/m$^2$ of CAP482-20 (20 s viscosity) cellulose acetate propionate, 0.06 g/m$^2$ of Paraplex G-25® plasticizer, 0.05 g/m$^2$ of monomeric glass illustrated below, and 0.005 g/m$^2$ divinylbenzene beads (2 μm beads) in a solvent mixture of toluene, methanol and cyclopentanone (66.5/28.5/5).

The cyan composition contained 0.10 g/m$^2$ of the first cyan dye illustrated above, 0.09 g/m2 of the second cyan dye illustrated above, 0.22 g/m$^2$ of the third cyan dye illustrated above, 0.23 g/m$^2$ of CAP482-20 (20 s viscosity) cellulose acetate propionate, 0.02 g/m$^2$ of Paraplex G-25® plasticizer, 0.04 g/m$^2$ of monomeric glass illustrated below, and 0.009 g/m$^2$ divinylbenzene beads (2 μm beads) in a solvent mixture of toluene, methanol and cyclopentanone (66.5/28.5/5).

The protective patch contained a mixture of poly(vinyl acetal) (0.53 g/m$^2$) (Sekisui KS-10), colloidal silica IPA-ST (Nissan Chemical Co.) (0.39 , g/m$^2$) and 0.09 g/m$^2$ of divinylbenzene beads (4 μm beads) which was coated from a solvent mixture of diethylketone and isopropyl alcohol (80:20).

Monomeric Glass

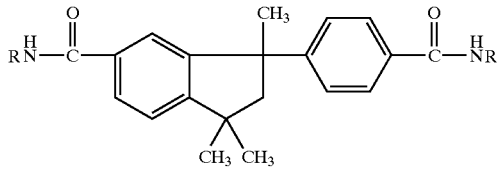

wherein R is

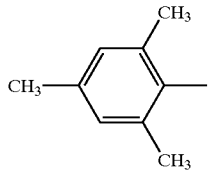

Example 1 (Comparative)

This example illustrates the preparation of microvoided dye-transfer receiving elements for comparison to the present invention. A Leistritz 27 mm Twin Screw Compounding Extruder heated to 275° C. was used to mix 1.7 μm beads made from 70 wt % methylmethacrylate crosslinked 30 wt % with divinylbenzene (Tg=160° C.) and a 1:1 blend of poly(ethylene terephthalate)("PET", commercially available as #7352 from Eastman Chemicals) and PETG 6763 polyester copolymer (poly(1,4-cyclohexylene dimethylene terephthalate)) from Eastman Chemicals). All components were metered into the compounder and one pass was sufficient for dispersion of the beads into the polyester matrix. The microbeads were added to attain a 33% by weight loading in the polyester. The compounded material was extruded through a strand die, cooled in a water bath, and pelletized. The pellets were then dried in a desiccant dryer at 65° C. for 12 hours. Then the resin pellets formulated as described above for the extruded dye receiving layer were dried in a desiccant dryer at 50° C. for 12 hours.

Then PET (#7352 from Eastman Chemicals) was dried in a desiccant dryer at 50° C. for 12 hours.

Cast sheets were co-extruded to produce a three layer structure using a 2½" extruder to extrude the PET, layer (3), a 1 "extruder to extrude the compounded pellets of polyester and microbeads, layer (2), and a ¾" extruder to extrude the compounded pellets of dye receiving layer, layer 1. Layers 2 and 3 were extruded at 275° C. while layer 1 was extruded at 250° C. The melt streams were fed into a 7 inch multi-manifold die heated at 275° C. As the extruded sheet emerged from the die, it was cast onto a quenching roll set at 55° C. The final dimensions of the continuous cast sheet were 18 cm wide and 480 μm thick. Layer (3) was 310 μm thick while layer (2) was 130 μm thick and layer 1 was 40 μm thick. The cast sheet was then stretched at 110° C. first 3.0 times in the X-direction and then 3.4 times in the Y-direction. The stretched sheet was then Heat Set at 150° C.

This composite film was then laminated to a 7 mil photographic grade paper support Example 2 (Comparative)

Another comparative sample made the same as Example 1 was also evaluated in which 1.7 μm beads made of 60 wt % methylmethacrylate and 10 wt % butylacrylate crosslinked with 30 wt % with hexane diol diacrylate (Tg=82° C.) were used in place of the 1.7 μm beads made from 70 wt % methylmethacrylate crosslinked 30 wt % with divinylbenzene of Example 1. These beads were also added at 33% by weight loading in the same polyester matrix as Example 1. The final dimensions of the continuous cast sheet was again 18 cm wide and 480 μm thick. Layer (3) was 310 μm thick while layer (2) was 130 μm thick and layer 1 was 40 μm thick. The sample was stretched the same as Example 1.

Example 3

In accordance to the present invention, another sample made the same as Example 1 was also evaluated in which 1.7 μm beads made of 25 wt % methylmethacrylate and 45 wt % butylacrylate crosslinked 30 wt % with trimethylol propane triacrylate (Tg=62° C.) were used in place of the 1.7 μm beads made from 70 wt % methylmethacrylate crosslinked 30 wt % with divinylbenzene of Example 1. These beads were also added at 33% by weight loading in the same polyester matrix as Example 1. The final dimensions of the continuous cast sheet was again 18 cm wide and 480 μm thick. Layer (3) was 310 μm thick while layer (2) was 130 μm thick and layer 1 was 40 μm thick. The sample was stretched the same as Example 1.

Example 4

In accordance with the invention, another sample made the same as Example 1 was also evaluated in which 1.7 μm beads made of 45 wt % methylmethacrylate and 25 wt % butylacrylate crosslinked 30 wt % with hexane diol diacrylate (Tg=56° C.) were used in place of the 1.7 μm beads made from 70 wt % methylmethacrylate crosslinked 30 wt % with divinylbenzene of Example 1. These beads were also added at 33% by weight loading in the same polyester matrix as Example 1. The final dimensions of the continuous cast sheet was again 18 cm wide and 480 μm thick. Layer (3) was 310 μm thick while layer (2) was 130 μm thick and layer 1 was 40 μm thick. The sample was stretched the same as Example 1.

Example 5

In accordance with the invention, another sample made the same as Example 1 was also evaluated in which 1.7 μm beads made of 30 wt % methylmethacrylate and 40 wt % butylacrylate crosslinked 30% with hexane diol diacrylale (Tg=33° C.) were used in place of the 1.7 μm beads made from 70 wt % methylmethacrylate crosslinked 30 wt % with divinylbenzene of Example 1. These beads were also added at 33% by weight loading in the same polyester matrix as Example 1. The final dimensions of the continuous cast sheet was again 18 cm wide and 480 μm thick. Layer (3) was 310 μm thick while layer (2) was 130 μm thick and layer 1 was 40 μm thick. The sample was stretched the same as Example 1.

Example 6

This Example illustrates the dye-transfer printing efficiency/quality of thermal dye-transfer receivers according to the present invention. An eleven-step sensitometric full color image was prepared from the above dye-donor and dye-receiver elements by printing the donor-receiver assemblage in a Kodak 8650 Thermal Printer. The dye-donor element was placed in contact with the polymeric receiving layer side of the receiver element. The assemblage was positioned on an 18 mm platen roller and a TDK LV5406A thermal head with a head load of 6.35 Kg was pressed against the platen roller. The TDK LV5406A thermal print head has 2560 independently addressable heaters with a resolution of 300 dots/inch and an average resistance of 3314Ω. The imaging electronics were activated when an initial print head temperature of 36.4° C. had been reached. The assemblage was drawn between the printing head and platen roller at 16.9 mm/sec. Coincidentally, the resistive elements in the thermal print head were pulsed on for 58 μsec every 76 μsec. Printing maximum density required 64 pulses "on" time per printed line of 5.0 msec. The voltage supplied at 13.6 volts resulted in an instantaneous peak power of approximately 58.18×10−3 Watt/dot and the maximum total energy required to print Dmax was 0.216 mJoules/dot. This printing process heated the laminate uniformly with the thermal head to permanently adhere the laminate to the print. The donor support was peeled away as the printer advanced through its heating cycle, leaving the laminate adhered to the imaged receiver.

After printing, Status A reflection densities of the 11-stepped image were measured with an X-Rite Model 820 densitometer (X-Rite Corp., Grandville, Mich.). The average $OD_{max}$ of yellow, magenta and cyan colors (Status A reflection densities) is shown in Table 1. Also shown in Table 1 is a visual assessment of the degree of graininess of each of the receivers.

TABLE 1

| SAMPLE | BEAD DESCRIPTION* | BEAD Tg (° C.) | PRINTED D max | PRINTED GRAININESS |
|---|---|---|---|---|
| Example 1 (Comparative) | MM/DVB 70/30 | 160 | 2.3 | POOR |
| Example 2 (Comparative) | MM/BA/HDD 60/10/30 | 82 | 2.2 | POOR |
| Example 3 (Invention) | MM/BA/TPT 25/45/30 | 62 | 2.2 | GOOD |
| Example 4 (Invention) | MM/BA/HDD 45/25/30 | 56 | 2.2 | V. GOOD |
| Example 5 (Invention) | MM/BA/HDD 30/40/30 | 33 | 2.1 | EXCELLENT |

*In the above Table, MM is ethyl, methacrylate, DVB is Divinylbenzene, BA is Butylacrylate, HDD is Hexane diol diacrylate, and TPT is Trimethylol propane triacrylate.
The numbers are weight % of each monomer.

The data in Table 1 demonstrates that the use of microbeads in the voided layer adjacent to the dye receiving layer with Tg's less than 80° C. results in a much lower level of printed graininess while maintaining dye transfer efficiency.

The invention has been described in detail with particular reference to preferred embodiments thereof, but it will be understood that variations and modifications can be effected within the spirit and scope of the invention. The entire contents of the patents and other publications referred to in this specification are incorporated herein by reference.

What is claimed is:

1. A thermal dye-transfer receiving element comprising:

(a) a dye-image receiving layer;

(b) beneath the dye-receiving layer, a microvoided layer containing a continuous phase polymer matrix having dispersed therein crosslinked organic microbeads, wherein the microbeads exhibit a glass transition temperature Tg which is below 80° C.

2. The element of claim 1 wherein the continuous phase polymer comprises a polyester polymer.

3. The element of claim 1 wherein said Tg is less than 75° C.

4. The element of claim 3 wherein the Tg of the microbeads is 35 to 70° C.

5. The element of claim 1 wherein the Tg of the microbeads is at least 15° C. below the Tg of the continuous phase polymer.

6. The element of claim 1 wherein the Tg of the microbeads is at least 45° C. below the Tg of the continuous phase polymer.

7. The element of claim 1 wherein the microbeads comprise a polymer made from the reaction product of a mixture of monomers comprising at least one crosslinking monomer and at least one monomer elected from the group consisting of butyl acrylate, ethyl acrylate, methyl methacrylate, styrene, ethylvinyl benzene, and vinyl toluene.

8. The element of claim 7 wherein the mixture of monomers comprises a monomer selected from the group consisting of butyl acrylate, methyl methacrylate, and mixtures thereof.

9. The element of claim 1 wherein the microbeads comprise a polymer made from a mixture of crosslinking monomers selected from the group consisting of ethylene glycol dimethacrylate, ethylene glycol diacrylate, 1,4-butanediol dimethylacrylate, hexane diol diacrylate, trimethylol propane triacrylate or divinylbenzene.

10. The element of claim 9 wherein the crosslinking monomers are selected from the group consisting of hexane diol diacrylate and trimethylol propane triacrylate.

11. The element of claim 1 wherein the microbeads comprise a polymer selected made from a mixture of crosslinking monomers which is 2.5 to 50 wt % of the total monomer used.

12. The element of claim 1 wherein the microbeads comprise a polymer selected made from a mixture of crosslinking monomers which is 20 to 40 wt % of the total monomer used.

13. The element of claim 1 wherein beneath said microvoided layer, there is a second microvoided layer comprised of a second continuous phase polyester matrix having dispersed therein non-crosslinked polymer particles that are immiscible with the polyester matrix of said second microvoided layer.

14. The element of claim 1 wherein said microvoided layer has a void volume of between 25% and 60 volume %.

15. The element of claim 1 wherein the first continuous phase polymer is a polyester and beneath said microvoided layer, there is a second layer comprised of a non-voided polyester.

16. The element of claim 1 wherein the microvoided layer further contains non-crosslinked polymer particles that are immiscible with the polymer matrix of said microvoided layer.

17. The element of claim 16, wherein beneath said microvoided layer, there is a second microvoided layer comprised of a second continuous phase polyester matrix having dispersed therein non-crosslinked polymer particles that are immiscible with the polyester matrix of said second microvoided layer.

18. The element of claim 1, wherein beneath said microvoided layer, there is a second layer comprised of a non-voided polyester.

19. The element of claim 1 wherein said dye-image receiving layer comprises a polymeric binder containing a polyester or polycarbonate.

20. The element of claim 1 wherein said dye-image receiving layer comprises a polyester and a polycarbonate polymer.

21. The element of claim 20 wherein said polyester and polycarbonate are present in the dye-image receiving layer in a weight ratio of polyester to polycarbonate of 0.8:1 to 4.0:1.

22. The element of claim 1 wherein said dye-image receiving layer further comprises a silicone release agent.

23. The element of claim 1 wherein said dye-image receiving layer further comprises a plasticizer comprising an ester or polyester.

24. The element of claim 1 wherein said continuous phase polymer of said microvoided layer comprises polyethylene (terephthalate) or a blend thereof.

25. The element of claim 24 wherein said continuous phase polyester of said microvoided layer is a blend comprising polyethylene(terephthalale) and poly(1,4-cyclohexylene dimethylene terephthalate).

26. The element of claim 1 wherein said microvoided layer has a density of less than 0.95 grams/cc.

27. The element of claim 1 wherein said second microvoided layer has a density of between 0.4 and 0.85 grams/cc.

28. The element of claim 1 wherein there is located beneath said microvoided layer a paper support or a resin-coated paper support.

29. The element of claim 1 wherein one or more subbing layers or tie layers are present in the receiving element.

30. The element of claim 1 wherein the total thickness of the element is from 20 to 400 micrometers.

31. The element of claim 1 wherein the total thickness of the element is from 30 to 300 micrometers.

32. A thermal dye-transfer assemblage comprising a dye-donor element, and the thermal dye-transfer receiving element of claim 1.

33. A method of forming an image comprising imagewise thermally transferring dyes onto the element of claim 1, such that the microbeads soften during the thermal printing process.

34. A process for making a thermal dye-transfer receiving element comprising the following steps:

a) coextruding a polymeric laminate film to form a cast composite film comprising at least two layers, a first layer comprising a non-voided thermoplastic polymeric material and a second layer comprising a continuous phase polymer matrix having dispersed therein crosslinked organic microbeads, wherein the microbeads exhibit a glass transition temperature Tg that is less than 80° C.;

b) stretching said cast composite film to reduce its thickness, thereby obtaining an oriented composite film comprising, as the first layer, a dye-image receiving layer and, as the second layer, a microvoided compliant layer; and c) laminating said oriented composite film to a support, such that the microvoided compliant layer is between the dye-image receiving layer and the support, to produce said thermal dye-transfer receiving element.

35. The process of claim 34 wherein said support comprises cellulose fiber paper.

36. The process of claim 35 wherein said support is from 120 to 250 $\mu$m thick and said composite laminate film is from 30 to 50 $\mu$m thick.

37. The process of claim 36 further comprising a polyolefin backing layer on the side of the support opposite to said composite film and a tie layer between the support and the composite laminate film.

38. The process of claim 35 wherein a third layer comprising a continuous phase polymer matrix having dispersed therein non-crosslinked polymer particles that are immiscible with the polyester matrix of said second microvoided layer, which third layer is coextruded and stretched with the first and second layers and wherein the third layer is located on the side of the second layer opposite the first layer.

39. The process of claim 34 wherein the Tg of the microbeads is 35 to 70° C.

40. The process of claim 34 wherein the continuous phase polymer matrix comprises a polyester polymer.

* * * * *